US010327569B2

(12) United States Patent
Greensmith et al.

(10) Patent No.: US 10,327,569 B2
(45) Date of Patent: Jun. 25, 2019

(54) PORTABLE STAND

(71) Applicant: SAFETYPOINT (MIDLANDS) LIMITED, Birmingham (GB)

(72) Inventors: Bradley Greensmith, Birmingham (GB); Michael Edwin Ayre, Oxfordshire (GB)

(73) Assignee: Safetypoint (Midlands) Limited (GB)

( * ) Notice: Subject to any disclaimer, the term of this patent is extended or adjusted under 35 U.S.C. 154(b) by 0 days.

(21) Appl. No.: 15/764,852

(22) PCT Filed: Sep. 26, 2016

(86) PCT No.: PCT/GB2016/052989
§ 371 (c)(1),
(2) Date: Mar. 29, 2018

(87) PCT Pub. No.: WO2017/060674
PCT Pub. Date: Apr. 13, 2017

(65) Prior Publication Data

US 2018/0279807 A1 Oct. 4, 2018

(30) Foreign Application Priority Data

Oct. 6, 2015 (GB) ..... 15176273.4

(51) Int. Cl.
*A47F 3/00* (2006.01)
*A47B 97/00* (2006.01)
(Continued)

(52) U.S. Cl.
CPC ..... *A47F 5/108* (2013.01); *A47F 3/142* (2013.01); *A47F 2003/0473* (2013.01)

(58) Field of Classification Search
CPC .. A47F 5/108; A47F 5/13; A47F 3/142; A47F 3/145
See application file for complete search history.

(56) References Cited

U.S. PATENT DOCUMENTS 392,038 A * 10/1888 Kraatz ..... F24F 13/20 312/100
873,855 A * 12/1907 Goldin ..... A45C 9/00 108/38
(Continued)

FOREIGN PATENT DOCUMENTS

| | | |
|---|---|---|
| JP | 2003049412 | 2/2003 |
| JP | 2014214438 | 11/2014 |
| WO | 2014200554 | 12/2014 |

OTHER PUBLICATIONS

Search Report for Great Britain Application No. GB1517627.4 dated Mar. 18, 2016.
(Continued)

*Primary Examiner* — Kimberley S Wright
(74) *Attorney, Agent, or Firm* — Tumey L.L.P.

(57) ABSTRACT

A portable stand (10) comprises a back wall (12), a base element (14), and two opposed end plates (16) between which the back wall and the base element extend, so to define an open-top box-like container. It also comprises legs (35) that can be folded up next to the base element (14); support arms (40) with a pivotal connection (42) so each support arm (40) can be moved between a closed position adjacent to the back wall (12), and a second position projecting upward from the back wall (12). In addition it comprises a front panel (20) hinged to the base element (14) so the front panel (20) can be swung between a position forming a front wall of the box-like container, and a position extending below the base element (14); and a top panel (22) hinged to the back wall (12) so it can be swung between a position forming a lid to the box-like container, and a position extending above the back wall (12). Swinging the front panel (20) and the top panel (22) in this way opens the box, and displays the exposed surfaces of the front panel (20) and of the top panel (22). There may be multiple display
(Continued)

chambers (66) within the box-like container which are thereby displayed. The portable stand enables the display of information on the exposed surfaces, and the display of items within the display chambers (66), for example for the purpose of safety.

22 Claims, 5 Drawing Sheets

(51) Int. Cl.
*A47F 5/10* (2006.01)
*A47F 3/14* (2006.01)
*A47F 3/04* (2006.01)

(56) References Cited

U.S. PATENT DOCUMENTS 910,659 A * 1/1909 Ford ..... A47F 7/283 211/85.26
2,400,320 A * 5/1946 Trefry ..... A47B 3/10 108/35
2,662,989 A * 12/1953 Thatcher ..... A47B 85/06 108/38
2,810,617 A * 10/1957 Slanhoff ..... A47F 5/108 108/33
2,944,862 A 7/1960 Heil
3,174,629 A * 3/1965 Gelberg ..... A47F 5/105 108/11
3,476,456 A * 11/1969 Canavan ..... A47B 3/10 312/231
3,543,890 A * 12/1970 Criswell ..... A47B 3/10 190/12
3,547,054 A * 12/1970 Caldwell ..... A47B 3/0815 108/115
3,734,595 A * 5/1973 Bendzick ..... B60Q 7/005 108/127
3,915,529 A * 10/1975 Bernier ..... A47B 3/10 126/37 B
4,076,348 A * 2/1978 Allison ..... A47B 97/08 248/461
4,195,889 A * 4/1980 Coyne ..... A47B 3/10 190/12 R
4,451,728 A * 5/1984 McKay ..... G07C 13/00 235/50 R
4,951,576 A * 8/1990 Cobos ..... A47B 3/0912 108/131
4,966,258 A * 10/1990 Hawley ..... A45C 9/00 190/12 R
5,666,765 A * 9/1997 Sarner ..... A47B 37/00 235/51
6,068,355 A * 5/2000 Thorp ..... A45C 9/00 108/177
6,340,213 B1 * 1/2002 Calobrisi, Jr. ..... A47B 3/12 108/25
6,454,064 B1 * 9/2002 Cheng ..... A45C 9/00 190/11
6,530,475 B1 * 3/2003 Penney ..... A45C 13/02 190/110
6,811,006 B1 * 11/2004 Mundle ..... A45C 13/02 190/1
7,543,704 B2 * 6/2009 Miller ..... B25H 1/04 190/11
8,051,783 B1 * 11/2011 Hoskinson ..... A47B 37/00 108/23
8,075,208 B2 * 12/2011 Green ..... A47B 21/00 400/685
8,322,291 B2 * 12/2012 Ceballos-Godefroy ..... A47B 3/10 108/38
8,534,779 B2 * 9/2013 Schaaf ..... A47B 46/005 312/272.5
8,800,455 B2 * 8/2014 Monroe ..... B62B 3/004 108/15
9,492,904 B1 * 11/2016 Dunn ..... B23Q 3/18
2004/0226791 A1 * 11/2004 Levy ..... A45C 9/00 190/11
2010/0329781 A1 12/2010 Conant
2012/0297688 A1 11/2012 Ceballos-Godefroy
2015/0206454 A1 * 7/2015 O'Neill ..... G09B 23/12 434/126

OTHER PUBLICATIONS

International Search Report for Application No. PCT/GB2016/052989 dated Jan. 4, 2017.
Written Opinion for PCT Application No. PCT/GB2016/052989 dated Jan. 4, 2017.

* cited by examiner

PORTABLE STAND

The present invention relates to a portable stand, in particular a portable stand which may be used to provide display surfaces for information and also provides storage for multiple items. It is for example suitable for storing safety items such as safety equipment and displaying safety information for an indoor or outdoor work place.

In work places such as construction sites and other high-risk environments (such as factories or oil rigs) there is an obligation to display certain safety information, and to provide certain safety equipment such as first aid kits and fire extinguishers. On a large construction site it may be necessary to provide such information displays at multiple locations, both indoor and outdoor, and to provide the safety equipment at multiple locations. The information displays may for example provide not only general safety information, but also important daily information messages, for example about high risk areas of operations. During the course of a building project it may then be necessary to move the displays and equipment to different areas as the work progresses; and when the building project is complete the displays and equipment would be removed. In many cases currently the display stands are put together from materials that are available on site, such as timber offcuts or plywood panels, and the stands are thrown away when the building project is complete. The need for safety information and safety equipment arises in many other contexts, such as mining, sports facilities, and public events. A readily portable stand that would not only provide display surfaces but also provide storage for safety items, and which could be readily transported and reused, would be advantageous.

According to the present invention there is provided a portable stand comprising elements that define an open-topped box-like container, the elements comprising a back wall, a base element, and two opposed end plates between which the back wall and the base element extend, wherein the portable stand also comprises:

(a) legs that are connected to the base element so they be moved between a first position adjacent to the base element and a second position projecting away from the base element;

(b) support arms with a pivotal connection near one end to the box-like container so each support arm can be moved between a first position adjacent to the back wall, and a second position projecting upward from the back wall;

(c) a front panel, and a first hinge connecting the front panel to the base element so the front panel can be swung between a position forming a front wall of the box-like container, and a position extending below the base element;

(d) a top panel, and a second hinge connecting the top panel to the back wall so the top panel can be swung between a position forming a lid to the box-like container, and a position extending above the back wall; and (e) at least one display chamber within the box-like container.

When the front panel is in the position forming a front wall of the box-like container, and the top panel is in the position forming a lid to the box-like container, then all the display chambers are enclosed within the box-like container, and if the legs are in their first position adjacent the base element, the portable stand can be readily transported. This may be referred to as the closed state of the portable stand. In one embodiment the end plates define at least two projections extending below their bottom edges, and at least two mating recesses along their top edges; alternatively the recesses may be defined in the bottom edges, and the projections defined in the top edges. The provision of such projections and mating recesses ensures that portable stands in their closed state can be readily stacked, with the projections of one portable stand locating in the recesses of the adjacent portable stand. The portable stands, in their closed position, therefore can be stacked on top of each other, and engagement between the projections and the recesses holds the stacked display stands in alignment in the stack; the recesses are shaped so as to prevent relative movement in the horizontal plane between adjacent portable stands in the stack. For example a stack of portable stands may be transported within a vehicle such as a van.

Each end plate may also include a handle, for example a handle that can be swung out, to make it easier to carry the portable stand, particularly when in its closed state.

When a portable stand, in its closed state, has been carried or transported to a location where it is to be used, the legs can then be swung into the second position, projecting downward to support the box-like container above the ground at an appropriate level. The legs may be linked together as rigid pairs, with such pair at each end of the portable stand, and may be connected by hinges to the base element. The connection to the base element may include a clip or a folding link to ensure that the legs are secure in the second position; such a clip or a folding link is commonly used to secure legs of trestle tables. At least some of the legs may also be provided with height-adjustable feet, so the portable stand can be set up on a surface that is not horizontal and flat.

In use, the portable stand would normally be set up with its legs in the second position, but in some cases (depending on location and environment) it may be more convenient to place the portable stand on a pre-existing table or support, and so not use the legs.

The portable stand can then be opened up into its open state. This involves swinging the front panel into the position extending below the base element; raising the support arms into the second position, extending upward; and swinging the top panel into the position extending above the back wall. The front panel may consist of a plurality of panels joined edge to edge by a hinge mechanism, for example to provide a larger surface area extending below the base element. Similarly the top panel may consist of a plurality of panels joined edge to edge by a hinge mechanism, to provide a larger surface area extending above the back wall. The top panel, having been opened up, would then be secured to the support arms.

When the portable stand is in its open state, the exposed surface area of the front panel provides a display area, and similarly the exposed surface area of the top panel provides a display area. It will be appreciated that the display area extending below the base element is defined by surfaces of the front panel that are enclosed within the box-like container when the portable stand is in the closed state; and similarly the display area extending above the back wall is defined by surfaces of the top panel that are enclosed within the box-like container when the portable stand is in the closed state.

The displayed information may for example be in the form of written instructions, essential safety briefings and current environmental operational briefings, maps, plans, diagrams or drawings. The display area may be provided with at least one transparent sleeve to contain and display information. Indeed the display area provided by the exposed surface area of the top panel may include multiple transparent sleeves, and may for example include transparent sleeves of different sizes to display information on different-sized pieces of paper, for example at least one transparent sleeve for A3-sized paper and at least one transparent sleeve for A4-sized paper. In an alternative, at least some of the display area may be provided by an electronic display in the form of a flat screen, which may display information, and may be user-interactive.

There are preferably multiple display chambers within the box-like container, and at least some of the display chambers may also be tipped up so their contents are more clearly visible. For example the portable stand may include at least one support bar that can be pivoted around a hinge to raise the display chambers adjacent to the back wall, so as to tilt the display chambers forwards. This improves visibility of the display chambers, and provides easier access to the contents. The number of display chambers depends on the number of items to be displayed. In the context of a safety display, the number of display chambers may for example be between 2 and 20, more typically between 3 and 10, for example between 4 and 8.

The pivotal connection between the support arm and the box-like container may include a spring-loaded rotary cam or dog clutch to ensure that the support arm is stable in the first position, adjacent to the back wall, and also in the second position, projecting upward. This may for example comprise a spring-loaded shaft which defines a cross-shaped portion that locates in a cross-shaped hole (or recess). The support arm can be pivoted only if a user displaces the spring-loaded shaft axially so the cross-shaped portion comes out of engagement with the cross-shaped hole; and when the support arm has been swung through 90° into the second position, the shaft would shift back into engagement with the cross-shaped hole, because of the spring, so the support arm is again stable.

As mentioned above, the first hinge connects the front panel to the base element; and the front panel itself may consist of a plurality of panels joined edge to edge by hinges. Each hinge may consist of a plurality of short hinges that are spaced apart, or a single long hinge of the type sometimes referred to as a piano hinge. In both these cases the hinge is a conventional, mechanical hinge, with a plurality of tube portions connected alternately to the two parts, held in alignment by a pin. Instead of a mechanical hinge, it will also be appreciated that at least one hinge may be provided by a flexible strip or sheet. Indeed such a flexible hinge-like strip or sheet may be integral with adjacent panels, for example being of a polymer material, the panels being for example laminated so as to be substantially rigid, while the linking portion of the sheet is thinner and flexible to act as the hinge.

The invention will now be further and more particularly described, by way of example only, and with reference to the accompanying drawings in which.

Figure 4:
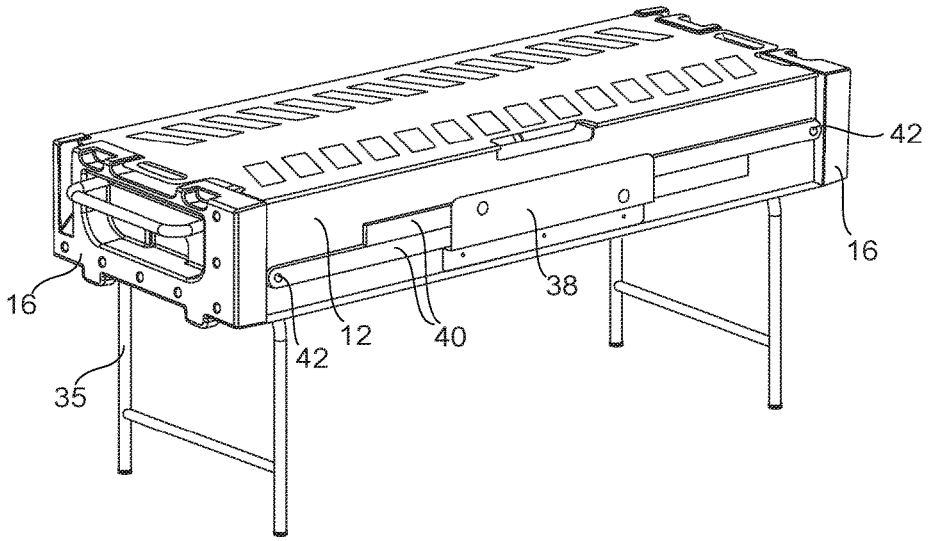
FIG. 4 shows a back perspective view of the portable stand as shown in FIG. 2.
Figure 4A:
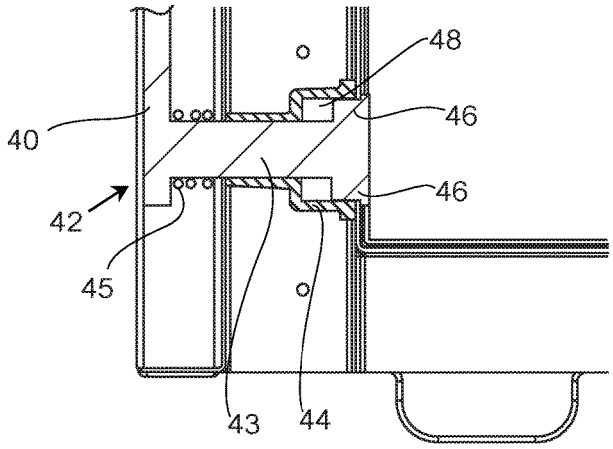
Figure 5:
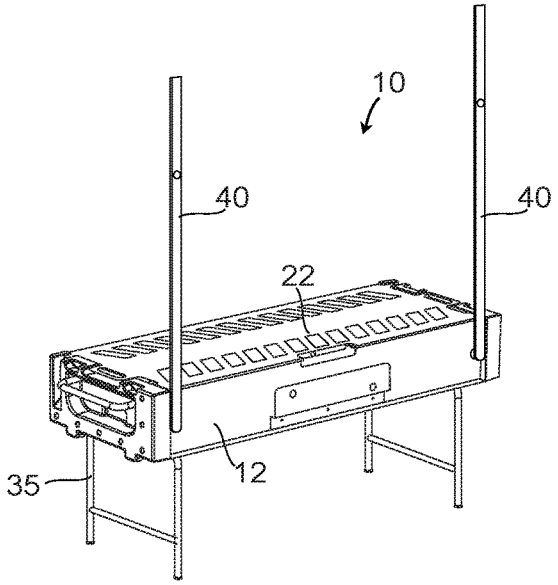
Figure 6:
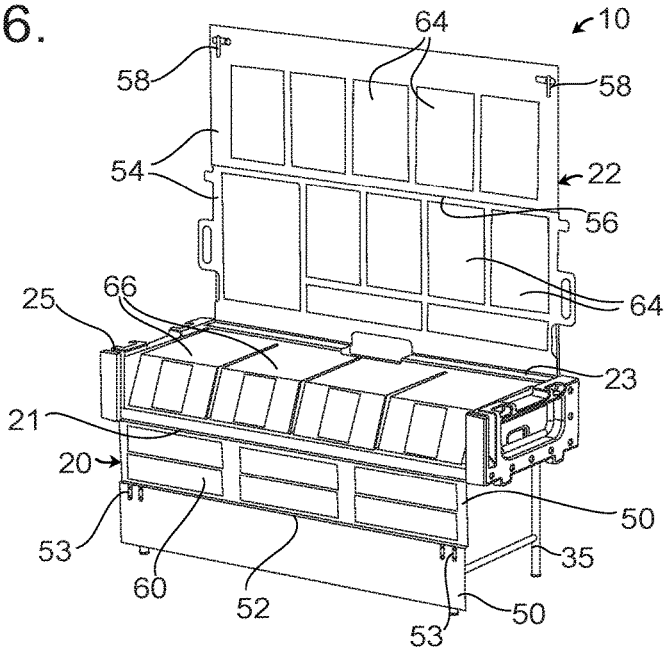
Figure 7:
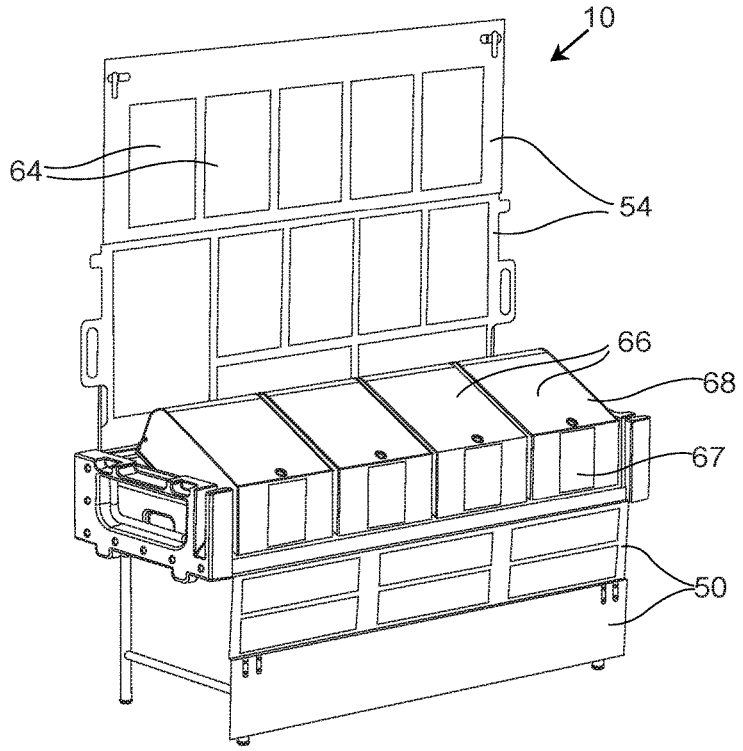
Figure 8:
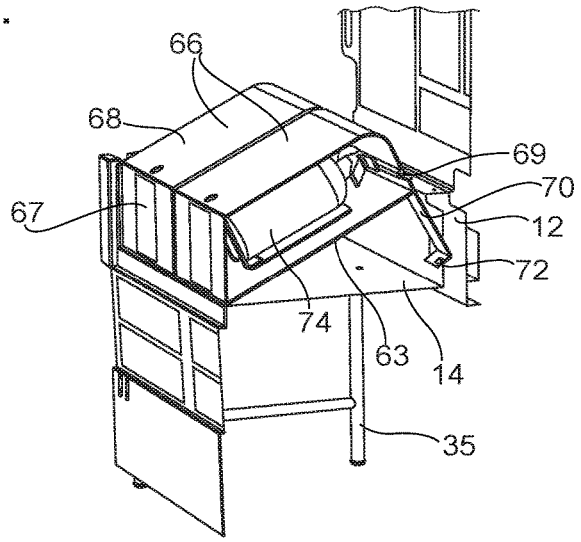

FIG. 4*a* shows a sectional view of part of a pivot mechanism for a support arm of the portable stand;

FIG. 5 shows a back perspective view of the portable stand with the support arms raised;

FIG. 6 shows a front perspective view of the portable stand in a partly-opened state;

FIG. 7 shows a front perspective view of the portable stand in its open state; and FIG. 8 shows a perspective sectional view of the portable stand in its open state.

Figure 1:
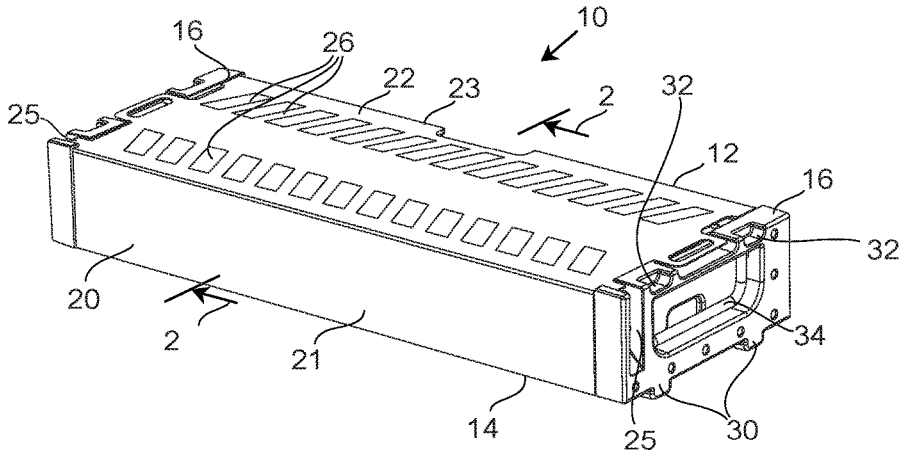
FIG. 1 shows a perspective view of a portable stand in its closed state.

Referring to FIG. 1 there is shown a portable stand 10 in its closed state, forming a box. The box consists of a back wall 12 and a base element 14 (which are both shown in FIGS. 2 and 8) which extend between end plates 16 and are joined to the end plates 16 to form an open-topped tray-like structure; the box is completed by a front panel 20 which is connected by a hinge 21 to the base element 14, and by a top panel 22 which is connected by a hinge 23 to the back wall 12. In the closed state it will be appreciated that the front panel 20 forms the front wall of the box, while the top panel 22 forms a lid of the box. A mechanical latch 25 on each end plate 16 holds the front panel 20 and the top panel 22 in this closed position. In this example the portable stand 10 is for displaying statutory information and specific information and equipment concerning safety, and the top surface of the top panel 22 is marked with bold yellow bars 26 to indicate this.

Each end plate 16 defines two projecting protrusions 30 on its lower edge, and defines two recesses 32 on its top edge, each protrusion 30 and each recess 32 being about half the thickness of the end plate 16. A number of portable stands 10 can be stacked on top of each other, with the protrusions 30 on one stand 10 locating in the recesses 32 on the next stand. The engagement between the protrusions 30 and the recesses 32 on adjacent stands in the stack prevents any relative movement in the horizontal plane, so the stack is stable for example during transport in a vehicle.

Figure 2:
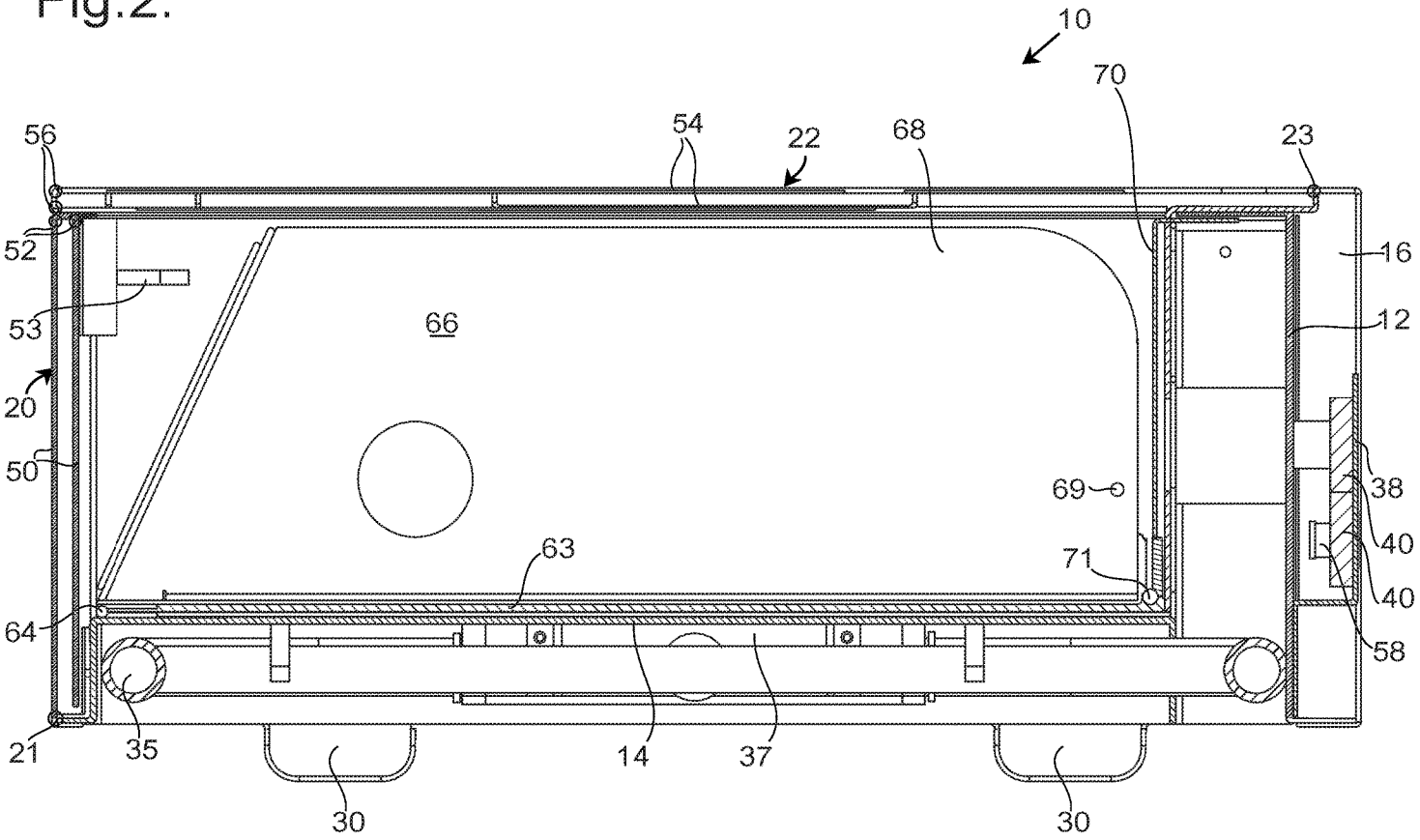
FIG. 2 shows a sectional view on the plane 2-2 of FIG. 1.

Referring to FIG. 2, this shows a sectional view in which the back wall 12 and the base element 14 are seen in section, and part of one end plate 16 is seen in elevation. The back wall 12 consists of two steel plates arranged to form an inverted trough. The front panel 20 and the top panel 22, and their respective hinges 21 and 23 are also shown in section. It will be appreciated that the protrusions 30 form projecting feet for the portable stand 10 in its closed state. The base element 14 is shaped as an inverted tray, so it defines a recess between the front panel 20 and the back wall 12. Two pairs of legs 35 (only one of which is shown in FIG. 2) are folded up into this recess. Other features that are shown in FIG. 2 are described in more detail below.

Figure 3:
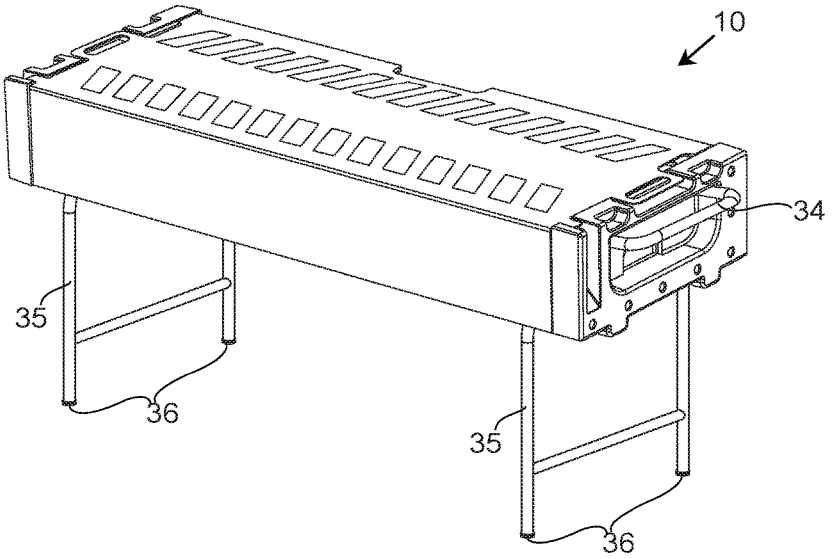
FIG. 3 shows a front perspective view of the portable stand of FIG. 1 with its legs in use.

Referring now to FIG. 3, each end plate 16 also includes a handle 34 which can be swung out from the end plate 16 (as shown in FIG. 3) to make it easier to carry the portable stand 10. Hence the portable stand 10 can be carried into a position where it is to be set up. The two pairs of legs 35 which are pivotally connected to opposite ends of the base element 14 can be swung down into the projecting position shown in FIG. 3. A spring latch 37 (indicated in FIG. 2) ensures that the pairs of legs 35 are secure in this projecting position, in which they carry the weight of the portable stand 10. At least some of the legs 35 may be provided with height-adjustable feet 36, so the portable stand 10 can be stable even on a surface that is not flat and horizontal.

Referring now to FIG. 4, which shows a perspective rear view, a bracket 38 projects from the back wall 12, and two support arms 40 rest on the bracket 38 in the closed state of the portable stand 10. Each support arm 40 is connected by a pivot mechanism 42 to the back wall 12, one at each end of the back wall 12. The pivot mechanism 42 is shown in more detail in FIG. 4*a*, to which reference is now made, this showing a sectional view through the pivot mechanism 42. A pivot shaft 43 projects from the support arm 40 through a guide 44 mounted in the back wall 12 and extending between the two steel sheets that form the back wall 12. A compression spring 45 surrounds the pivot shaft 43 between the support arm 40 and the outer face of the back wall 12. The inner end of the pivot shaft 43 has four equally-spaced radially-projecting fins 46, so it is cross-shaped. This inner end locates as shown in a similar cross-shaped recess 48 in the inner end of the guide 44. The support arm 40 is therefore not free to turn around the pivot mechanism 42 until it is pushed in against the force of the compression spring 45, to free the radially-projecting fins 46 from the cross-shaped recess 48. When the support arm 40 has been turned through 90°, the compression spring 45 will cause the fins 46 to re-engage with the cross-shaped recess 48, so the support arm 40 will again be held securely, until it is again pushed in against the force of the compression spring 45.

Hence, as shown in FIG. 5, the support arms 40 can then be swung into an upright position, in which they are stable.

Referring now to FIG. 6, by releasing the latches 25, the front panel 20 can then be swung around the hinge 21 to hang below the base element 14. In this example the front panel 20 consists of two display panels 50 joined edge-to-edge by a hinge 52, and the lower display panel 50 is then clipped onto an adjacent leg 35 by a spring clip 53 (shown in elevation in FIG. 2). Similarly, the top panel 22 can be swung around the hinge 23 to project above the back wall 12, up against the support arms 40. In this example the top panel 22 consists of two display panels 54 joined edge-to-edge by a hinge 56, and the upper display panel 54 is then secured to the support arms 40 by a clip 58.

Although in FIG. 6 the hinges 52 and 56 are indicated as single hinges, as shown in FIG. 2 it will be appreciated that they are actually two closely-spaced parallel hinges, to allow the display panels 50 or 54 to lie parallel to each other in the closed state.

The display panels 50 in this example display safety information on their front surfaces, as indicated by the rectangles 60. In the closed state (as described above) the front surfaces of the display panels 50 are folded against each other about the hinge 52, to form the front panel 20, and so in the closed state the front surfaces are not exposed. Similarly the display panels 54 display safety information on their front surfaces, as indicated by the rectangles 64. In the closed state, as described above and as shown in FIG. 2, the front surfaces of the display panels 54 are folded against each other about the hinge 56 to form the top panel 22, and so in the closed state the front surfaces are not exposed.

The display panels 50 and 54 may be provided with information printed directly onto the display panels 50 and 54. In this example this is the case for the display panels 50. In this example the rectangles 64 on the display panels 54 indicate transparent plastic sleeves that are fixed to the display panels 54, and are of such a size that paper with safety information can be displayed within the plastic sleeves, for example site-specific safety information. In this example there are nine plastic sleeves suitable for taking A4 sheets of paper, and one plastic sleeve for taking a larger sheet of paper, for example A3. The displayed information may for example be in the form of written instructions, maps, plans, diagrams or drawings; and in the present example is primarily concerned with safety.

Opening up the front panel 20 and the top panel 22 in this way discloses the contents of the open-topped tray-like structure formed by the back wall 12, the base element 14 and the end plates 16. Within this tray-like structure, in this example, are four interconnected display boxes 66, each with a label 67 on the front and with a transparent cover 68 with a hinge 69 at the back (see FIGS. 2 and 8). The display boxes 66, as shown in FIG. 2, are mounted on a base plate 63 which is connected by a hinge 64 to the front of the base element 14, and which rests on the top of the base element 14 in the closed state.

Referring now to FIG. 7 and FIG. 8, the display boxes 66 are then tilted forward by raising a strut 70. In the closed state, as shown in FIG. 2, the strut 70 extends upward from a hinge 71 at the rear edge of the base plate 63, so the strut 70 can be used as a handle to raise the base plate 63 with the display boxes 66 on it. The strut 70 is then swung into position below the base plate 63, and as shown in FIG. 8, in this example it locates onto a projecting tab 72 in an aperture in the back wall 12. The portable stand 10 is then in its open state, in which the information displayed on the display panels 50 and 54 is clearly visible, and the safety equipment in the display boxes 66 is also clearly visible and accessible. By way of example the four display boxes 66 might contain a first aid kit, a fire extinguisher 74, an eye-wash bottle, and a battery-powered alarm, respectively.

It will be appreciated that the transparent lids 68 ensure that the safety items can be seen, so it is easy to check the items are present, while keeping dust off the safety items, and the hinges 69 provide easy access when a safety item is required. Each lid 68 may be provided with a breakable tag, so it is easy to see if the lid 68 has been opened. Hence a simple visual inspection can assess if a safety item has been used or damaged, or requires replacement.

It will be appreciated that the information displayed on the display panels 50 and 54, and indeed the safety items in the display boxes 66, would be selected as required in accordance with the site where the portable stand 10 is to be used. However, if the portable stand 10 is used on construction sites, much of the information will be the same in each case, and the safety items may also be the same in each case.

In any event it will be appreciated that the stand 10 can be readily erected as described above; and when it is no longer required in a particular location, the portable stand 10 can be readily returned to its closed state, in which state it can be carried or transported to a new place where it is required. The sequence of steps is merely the reverse of those described above: the strut 70 is lowered so the display boxes 66 lie flat (as shown in FIG. 6); the display panels 54 are disconnected from the support arms 40, and folded up to form the top panel 22, and the display panels 50 are disconnected from the legs 35 and folded up to form the front panel 20, and the latches 25 are secured, so as to reach the state shown in FIG. 5; the support arms 40 are then swung back to rest in the bracket 38, and the legs 35 are swung back up against the base element 14, so the portable stand 10 is in the closed state shown in FIG. 1.

Although the portable stand 10 has been described particularly in relation to safety information and safety equipment, it will be appreciated it may be used for other purposes where both information and items are to be displayed.

It will be appreciated that the components of the portable stand 10 may be made of a variety of different materials, and that the choice of materials will depend at least in part upon the situation in which the portable stand 10 is intended to be used. For example in some cases a robust structure will be required; while in other cases weight reduction will be a more significant consideration. Many of the components may be made of sheet steel, or of aluminium. The sheet elements such as the display panels 50 and the display panels 54 and the display boxes 66 may be made of a metal sheet or a polymer sheet, or a fibre reinforced polymer sheet, or of a wood-based sheet material such as plywood, or a composite material for example consisting of a honeycomb structure sandwiched between two polymer sheets (such as that sold under the trade mark Nidaplast). For example the use of carbon fibre reinforcement can enhance rigidity; while the use of a sandwiched polymer honeycomb structure can lead to a reduction in weight.

What is claimed:

1. A portable stand comprising elements that define an open-topped box-like container, the elements comprising a back wall, a base element, and two opposed end plates between which the back wall and the base element extend, wherein the portable stand also comprises:

(a) legs that are connected to the base element so they be moved between a first position adjacent to the base element and a second position projecting away from the base element;

(b) support arms with a pivotal connection near one end to the box-like container so each support arm can be moved between a first position adjacent to the back wall, and a second position projecting upward from the back wall;

(c) a front panel, and a first hinge connecting the front panel to the base element so the front panel can be swung between a position forming a front wall of the box-like container, and a position extending below the base element;

(d) a top panel, and a second hinge connecting the top panel to the back wall so the top panel can be swung between a position forming a lid to the box-like container, and a position extending above the back wall; and (e) at least one display chamber within the box-like container.

2. A portable stand as claimed in claim 1 wherein the end plates define at least two projections extending below their bottom edges, and at least two mating recesses along their top edges.

3. A portable stand as claimed in claim 2 wherein each end plate also includes a handle.

4. A portable stand as claimed in claim 1 wherein the front panel consists of a plurality of panels joined edge to edge by a hinge mechanism, such that when the front panel is in the position extending below the base element and so presenting an exposed surface, the plurality of panels can unfold to form a larger exposed surface.

5. A portable stand as claimed in claim 1 wherein the top panel consists of a plurality of panels joined edge to edge by a hinge mechanism, such that when the top panel is in the position extending above the back wall and so presenting an exposed surface, the plurality of panels can unfold to form a larger exposed surface.

6. A portable stand as claimed in claim 4 comprising panels that are joined edge to edge by a hinge mechanism, wherein each hinge mechanism comprises two parallel hinges linked together.

7. A portable stand as claimed in claim 1 wherein, when the front panel is in the position extending below the base element and so presenting an exposed surface and the top panel is in the position extending above the back wall and so presenting an exposed surface, at least some of the exposed surfaces are used to display information.

8. A portable stand as claimed in claim 7 wherein at least one of the exposed surfaces is provided with at least one transparent sleeve to contain and display information.

9. A portable stand as claimed in claim 7 wherein at least one of the exposed surfaces is provided with an electronic information display.

10. A portable stand as claimed in claim 1 wherein there are multiple display chambers within the box-like container.

11. A portable stand as claimed in claim 10 wherein the number of display chambers is between three and ten.

12. A portable stand as claimed in claim 11 wherein each display chamber has a transparent cover.

13. A portable stand as claimed in claim 11 also comprising at least one support bar that can be pivoted around a hinge to raise the display chambers adjacent to the back wall, so as to tilt the display chambers forwards.

14. A portable stand as claimed in claim 1 wherein the pivotal connection between the support arm and the box-like container comprises a spring-loaded rotary cam or dog clutch to ensure that the support arm is stable in the first position, adjacent to the back wall, and also in the second position, projecting upward.

15. A portable stand as claimed in claim 14 wherein the spring-loaded rotary cam or dog clutch comprises a spring-loaded shaft which defines a generally cross-shaped portion that locates in a generally cross-shaped hole.

16. A portable stand as claimed in claim 5 comprising panels that are joined edge to edge by a hinge mechanism, wherein each hinge mechanism comprises two parallel hinges linked together.

17. A portable stand comprising elements that define an open-topped box-like container, the elements comprising a back wall, a base element, and two opposed end plates between which the back wall and the base element extend, wherein the portable stand also comprises:

(a) legs that are connected to the base element so they be moved between a first position adjacent to the base element and a second position projecting away from the base element;

(b) support arms with a pivotal connection near one end to the box-like container so each support arm can be moved between a first position adjacent to the back wall, and a second position projecting upward from the back wall;

(c) a first element which can be displaced from the box-like container into a position extending below the base element;

(d) a second element which can be displaced from the box-like container into a position extending above the back wall; and (e) at least one display chamber within the box-like container.

18. A portable stand as claimed in claim 17 wherein, when the first element is in the position extending below the base element and so presenting an exposed surface and the second element is in the position extending above the back wall and so presenting an exposed surface, at least some of the exposed surfaces are used to display information.

19. A portable stand as claimed in claim 18 wherein at least one of the exposed surfaces is provided with at least one transparent sleeve to contain and display information.

20. A portable stand as claimed in claim 18 wherein at least one of the exposed surfaces is provided with an electronic information display.

21. A portable stand as claimed in claim 18 wherein the pivotal connection between the support arm and the box-like container comprises a spring-loaded rotary cam or dog clutch to ensure that the support arm is stable in the first position, adjacent to the back wall, and also in the second position, projecting upward.

22. A portable stand as claimed in claim 21 wherein the spring-loaded rotary cam or dog clutch comprises a spring-loaded shaft which defines a generally cross-shaped portion that locates in a generally cross-shaped hole.

* * * * *